United States Patent [19]

Ducote

[11] Patent Number: 4,552,706

[45] Date of Patent: Nov. 12, 1985

[54] LINER-PROPELLANT BOND TESTS

[75] Inventor: Marjorie E. Ducote, Huntsville, Ala.

[73] Assignee: The United States of America as represented by the Secretary of the Army, Washington, D.C.

[21] Appl. No.: 539,201

[22] Filed: Oct. 5, 1983

[51] Int. Cl.[4] ..... C06B 21/00; C06B 45/10

[52] U.S. Cl. ..... 264/3 R; 73/788; 102/290; 102/291; 149/19.9

[58] Field of Search ..... 264/3 R; 102/290, 291; 149/19.9; 73/788, 789, 802, 804

[56] References Cited

U.S. PATENT DOCUMENTS

| | | | |
|---|---|---|---|
| 3,010,354 | 11/1961 | Adelman | 102/290 |
| 3,813,308 | 5/1974 | Skidmore | 264/3 R |
| 3,904,715 | 9/1975 | Sieg et al. | 264/3 R |
| 4,042,441 | 8/1977 | Wasserman et al. | 102/290 |
| 4,120,153 | 10/1978 | Schaffling | 102/290 |
| 4,180,535 | 12/1979 | Rhoades | 264/3 R |
| 4,209,351 | 6/1980 | Pierce et al. | 102/290 |
| 4,337,218 | 6/1982 | Byrd et al. | 264/3 R |
| 4,361,526 | 11/1982 | Allen | 264/3 R |
| 4,429,634 | 2/1984 | Byrd et al. | 102/290 |
| 4,458,595 | 7/1984 | Gerrish, Jr. et al. | 102/290 |

*Primary Examiner*—Stephen J. Lechert, Jr.
*Assistant Examiner*—Howard J. Locker
*Attorney, Agent, or Firm*—Anthony T. Lane; Robert P. Gibson; Jack W. Voigt

[57] ABSTRACT

A method of determining tensile bond strength and lap shear strength between a liner/insulation material and a propellant composition which is cured to portions of the liner/insulation material.

The liner/insulation material is bonded to a propellant composition in a dogbone configuration by positioning a predetermined size of the liner/insulation material in a groove that is constructed in a mold in a transverse direction for a tensile bond strength specimen whereby the propellant is bonded to each side of the exposed liner/insulation material. The lap shear specimen is formed in a mold wherein a predetermined size of the liner/insulation material is longitudinally positioned in a groove that is constructed in a mold. The liner/insulation material is centered with a pair of spacers having about one-half of the length of the liner/insulation material to prevent a cast propellant composition from binding to the portion covered by the spacers but to permit the remaining portion of the liner/insulation material to be embedded and cured in the propellant composition that is cast and cured in the mold. After curing the tensile strength specimen and the lap shear specimen having the liner/material bonded to the cured propellant, each specimen is tested in an Instron testing machine to determine bond strength and bond characteristics of the test specimens by evaluating the strain at maximum stress, maximum strain, type of break and total area under the stress strain curve.

6 Claims, 4 Drawing Figures

LINER-PROPELLANT BOND TESTS

DEDICATORY CLAUSE

The invention described herein may be manufactured, used, and licensed by or for the Government for governmental purposes without the payment to me of any royalties thereon.

BACKGROUND OF THE INVENTION

A major cause of missile failure due to uneven burning, overheating, or uneven pressure gradients can be attributed to weak bond strength of propellant to liner, propellant to insulation, and/or propellant or insulation to rocket motor case.

Presently used tests designed to measure propellant to liner, propellant to insulation, and/or propellant or insulation to rocket motor case bond strengths and lap shears require special fixtures and at times give less than desirable results.

Advantageous would be the use of test models and procedures which are simpler, do not require special hardware and which can be tested in an Instron test machine, a test machine well known in the propellant mechanical properties testing field.

Therefore, an object of this invention is to provide test models and procedures which are simpler to use and do not require special hardware.

A further object of this invention is to provide test models and procedures which can be tested in an Instron test machine to determine bond strength (tensile).

Still another object of this invention is to provide test models and procedures which can be tested in an Instron test machine to determine lap shear strength.

SUMMARY OF THE INVENTION

Disclosed is a method for preparing tensile and lap shear strength specimens for determining bond strength between a liner/insulation material of a predetermined dimension and thickness and having surfaces facing in opposite directions and a propellant composition. An uncured propellant composition is cast onto portions of the surfaces of the liner/insulation material. An additional amount of the propellant composition is cast around the liner/insulation material to complete a JANNAF type dogbone configuration of a test specimen of about 5 inches long, $\frac{3}{4}$ inch thick, and $\frac{3}{8}$ inch wide which after curing is tested in a standard Instron machine for either tensile strength or lap shear strength.

The mold for the tensile strength specimen is provided with a groove which transverses the center of the mold in a predetermined position to enable a piece of liner/insulation material of a predetermined dimension and thickness and having surfaces facing in opposite directions to be retained in a fixed position while uncured propellant is cast onto two opposing surfaces of the liner/insulation material positioned in the groove. The lap shear specimen mold is provided with a pair of longitudinal grooves in communication with a slot which enables a piece of liner/insulation material of a predetermined dimension to be placed in a predetermined position to enable propellant to be cast onto oppositely facing surfaces at opposite ends of the liner-/insulation material while spacer means shield an intermediate portion of the surfaces to cause a discontinuance of propellant in a center portion of each side of the liner/insulation material. The lap shear specimen is also finished to a JANNAF type dogbone configuration which is tested in an Instron test machine for lap shear strength.

DESCRIPTION OF THE PREFERRED EMBODIMENT

Bond strength and lap shear strength tests require test specimen that are each designed specifically to meet the needs of a bond strength (tensile) test spcimen and a lap shear strength test specimen.

Thus, molds for forming the specific test specimen to demonstrate the concepts of this invention are either cast from RTV630 (room temperature vulcanizing) rubber or from metal that is machined to design and coated with teflon. The molds for the test specimens are designed to produce JANNAF type dogbone specimens of dimensions of about 5 inches long, $\frac{3}{4}$ inch thick, and $\frac{3}{8}$ inch wide.

The mold for the tensile bond specimen is provided with a groove about $\frac{1}{8}$ inch deep cut transversely in the center of the mold bottom and in the vertical side wall. This groove is for positioning a piece of liner/insulation material (having a predetermined dimension and thickness and having surfaces facing in opposite direction). An uncured propellant composition is cast against the liner/insulation material to prevent the formation of voids at the interface. Then the remainder of the mold is filled with propellant which is subsequently cured, the test specimen is removed, and then tested in an Instron test machine.

Similarly, a mold for lap shear specimens conains a pair of $\frac{1}{8}$ inch deep, $\frac{1}{4}$ inch long, and $\frac{1}{8}$ inch wide longitudinal grooves cut in the center of the bottom portion of the mold, centered with respect to the mold and on opposite sides of a slot centered with respect to both length and width of the mold. This pair of grooves is for positioning a one-inch square sample of liner/insulation. The pair of grooves are in communication with a slot of about $\frac{3}{8}$ inch wide, $\frac{1}{2}$ inch long, and $\frac{1}{8}$ inch deep cut in the mold bottom such that the liner/insulation groove extends $\frac{1}{4}$ inch beyond each end of the $\frac{1}{2}$ inch long slot. Teflon spacers are positioned in the described slot and on opposite sides of the liner/insulation material to retain the liner/insulation material and to prevent propellant from flowing onto the portion of the liner/insulation material protected by the teflon spacers. The resulting dogbone specimen has a discontinuance of propellant in the center portion of the liner/insulation material with $\frac{1}{4}$ inch of each end of liner/insulation sample being embedded in the propellant. Propellant is cast just around the protruding ends of the liner/insulation and then the mold is filled. When the propellant is cured the dogbone configuration specimen is removed from the mold and teflon spacers and tested in an Instron.

Figure 1:
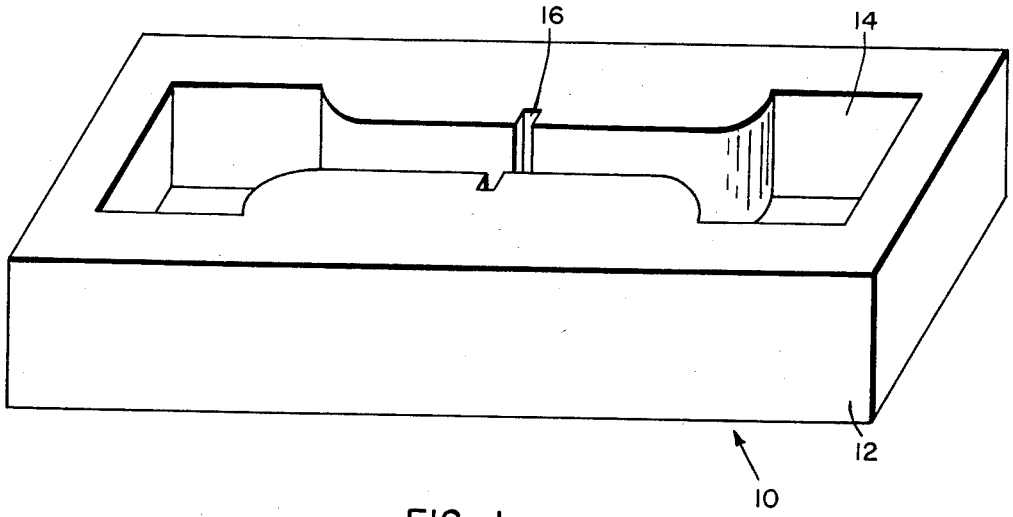
FIGS. 1–2 of the drawing illustrate a mold for a tensile bond specimen and the tensile specimen in a dogbone configuration after being removed from a mold.

In further reference to the figures of the drawing, FIG. 1 depicts a mold 10 for forming a dogbone type tensile strength specimen. The mold body 12 having the configuration of a dogbone 14 therein is shown with a groove 16 cut in a transverse direction of the length of the mold. This groove is for positioning a piece of liner-/insulation material to which propellant is cast and cured.

Figure 2:
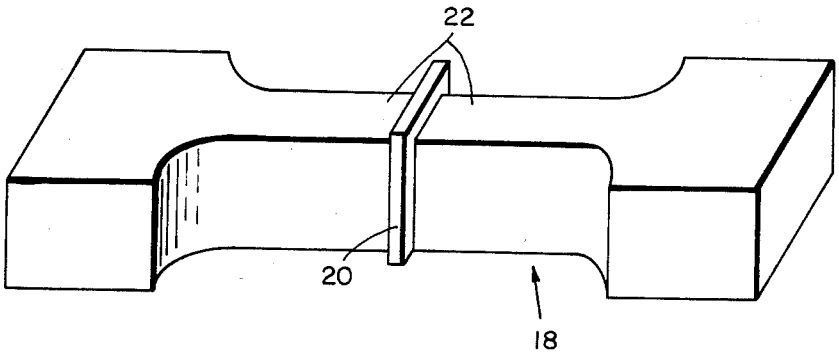

FIG. 2 shows a tensil strength specimen 18 in a dogbone configuration. A piece of liner/insulation material 20 is shown with propellant 22 cured to each side of surfaces facing in opposite directions.

Figure 3:
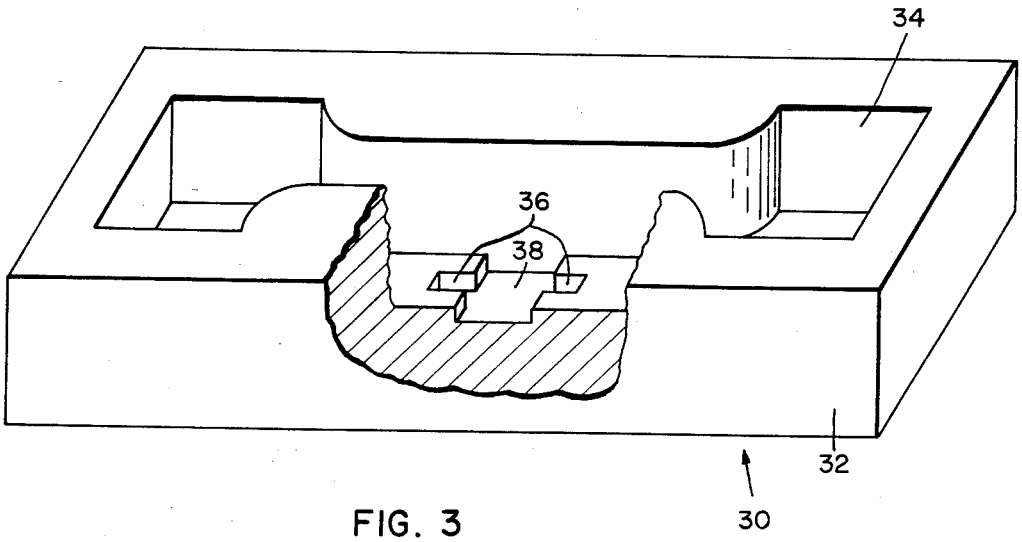
FIGS. 3–4 of the drawing illustrate a mold for a lap shear specimen and a lap shear specimen in a dogbone configuration after being removed from a mold.

FIG. 3 depicts a mold 30 for forming a dogbone type shear specimen. The mold body 32 having the configuration of a dogbone 34 therein is shown with a pair of longitudinal grooves 36 cut into the center portion of the bottom of the mold. These longitudinal grooves are in communication with a slot 38 on opposite sides thereof. These grooves are for positioning a piece of liner/insulation material therein with a center portion of the liner/insulation material extending across a center portion of slot 38. A pair of teflon spacers (not shown) are of approximately ½ the length of the liner/insulation material and are for positioning in slot 38 on opposite sides of the liner/insulation material. These spacers retain the liner/insulation material in place and shield the liner/insulation material from propellant contact during propellant casting. Around the exposed portions of the liner/insulation material an uncured propellant composition is cast to cover or embed a portion of each end of the liner/insulation material. The propellant composition is then cast to fill the mold. The propellant composition is cured, and the dogbone lap shear specimen is removed from the mold and the teflon spacers and tested in an Instron machine. The lap shear specimen, has a discontinuance of propellant in the center portion where the teflon spacers prevented the propellant from contacting the liner/insulation material. Thus only ¼ inch of each end of the liner/insulation material is embedded in the cured propellant.

Figure 4:
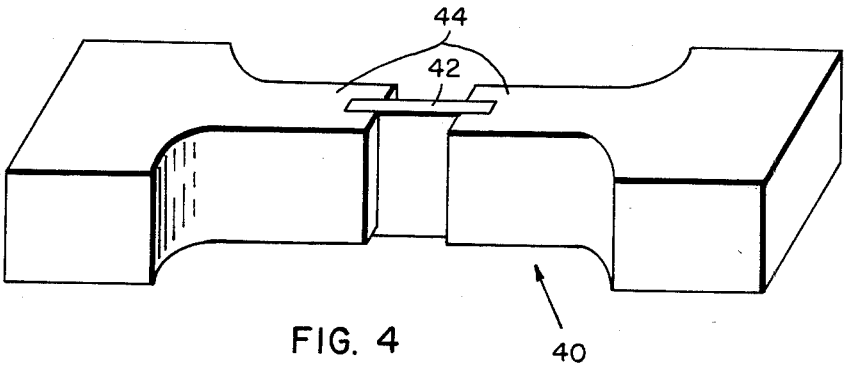

FIG. 4 shows a lap shear specimen 40 having a dogbone configuration. A piece of the liner/insulation material 42 is shown embedded at each end portion in cured propellant 44.

Prepartion of Tensile Strength Test Specimen EPDM (abbreviation for elastomers made with ethyleneepropylene diene monomers) slabs are prepared by first cleaning the surface with methylene chloride. The surfaces are roughened with steel wool and rinsed with methylene chloride. Residual steel wool is removed by passing a magnet wrapped in a paper towel over the surface. After a final methylene chloride rinse, the EPDM slabs are dried in an oven at 170° F. overnight. Specimens are cut from the slabs, ⅝×1 inches for tensile tests and 1 inch square for lap shear. Specimens for coating are painted with TS3320-19 EPDM primer and baked for 30 minutes at 250° F.

Positioning EPDM in Molds

Specimens are centered in molds by means of the grooves. In the lap shear specimen, teflon pieces are centered on each side of the EPDM. This results in ¼ inch end portions of the EPDM specimen to be embedded in the cast propellant.

Propellant Composition Preparation, Casting, and Curing to EPDM in Molds

A master batch of propellant is prepared and divided into six parts, one for each type EPDM. The propellant is an HTPB hydroxyterminated polybutadiene propellant containing 3.6% DOS, dioctyl sebecate. The bonding agent, cure catalyst, and curing agent are omitted until immediately before use. After final processing of a subbatch of propellant, the liquid propellant is cast against the EPDM specimens by means of a cake decorator equipped with a special long nozzle. After the EPDM surfaces are wetted with propellant (to prevent bubbles at the interfaces) the remainder of the dogbone is filled with propellant. Six specimens are prepared at a time, three tensile and three lap shear, using specimens from the same EPDM sample (e.g. vulcanized, vulcanized coated, etc.) After the propellant is cured, the molds are placed in a freezer for several hours to facilitate removal of the test specimens. Six groups of test specimens are generally prepared.

Code For Mix Sample Numbers

1. O-U—vulcanized, uncoated.
2. O-C—vulcanized, coated with TS3320-19*.
3. 78-U—peroxide cured, uncoated.
4. 78-C—peroxide cured, coated with TS3320-19.
5. 79-U—peroxide cured, preplasticized, uncoated.
6. 79-C—peroxide cured, preplasticized, coated with TS3320-19.

(*TS3320-19 is rubber primer product number of Lord Hughson Chemicals employed for coating EPDM)

Tensile specimens for propellant properties of each of the six subbatches of propellant are also prepared. Upon completion of the six sets, the test specimens and propellant tensile specimens are pulled at 75° F. in the Instron. The cross head speed is 2.0 in/min and load scale is 20 pounds. Propellant physical properties at −40° F. and 75° F. are shown in Table 1.

Several parameters where chosen as indicative of degree of bonding between propellant and EPDM, strain at maximum stress, maximum strain (tensile specimens), type of break and area under the stress strain curve. A summary of test results appears in Table 2.

Bond between the vulcanized EPDM and propellant was extremely poor. Most samples fell apart before they could be tested. The propellant at the interface was very tacky, no propellant remained on the EPDM. The coated vulcanized EPDM showed a little improvement. The area under the curve of the lap shear specimens increased from 1.05, uncoated, to 4.26 sq. in., coated. Stress increased significantly, however strain only increased from 4.7 to 10.5%. Failure again occurred at the interface.

The propellant bonded better to the peroxide cured EPDM. The lap shear specimens showed an increase in area under the stress strain curve to 9.27 sq. in. for the uncoated and 9.34 sq. in. for the coated unplasticized peroxide cured EPDM. The increase was even greater for the plasticized peroxide cured EPDM 13.64 sq. in. for the uncoated, 10.23 sq. in. for the coated. This increase may be the result of less plasticizer migration from the propellant at the interface. Tensile tests also showed the superior adhesion of the peroxide cured EPDM. All uncoated vulcanized EPDM specimens fell apart, area under the curve for the coated samples was only 1.47 sq. in., with 44 pounds stress and 8.13% strain. The area under the curve was 9.53 sq. in. for the unplasticized peroxide cured EPDM and 9.42 sq. in. for the preplasticized. The area under the stress strain curve was slightly higher for the coated specimens, 11.31 sq. in. for the unplasticized and 12.92 for the preplasticized. All the specimens failed in the propellant rather than at the interface except the coated preplasticized EPDM. This may be explained by the significantly higher propellant tensile strength of this propellant subbatch, which was higher than that required to break the bond between propellant and liner, 121 vs 95 psi.

TABLE 1

PHYSICAL PROPERTIES OF PROPELLANT

| Mix Sample Number | −40 Strain, % | | | Amb. (75° F.) | | |
|---|---|---|---|---|---|---|
| | Stress | Max/bk | Modulus | Stress | Max/bk | Modulus |
| OU | 243 psi | 61.5/74.1 | 1712 psi | 94.8 psi | 41.5/42.1 | 470 psi |
| OC | 291 | 58.9/70.8 | 1795 | 115.4 | 41.8/43.2 | 524 |
| 78U | 184 | 35.3/51.6 | 1563 | 75.2 | 32.4/35.3 | 435 |
| 78C | 171 | 39.8/56.2 | 1314 | 75.6 | 38.0/42.6 | 404 |
| 79U | 218 | 57.9/61.5 | 1359 | 80.5 | 27.7/39.1 | 391 |
| 79C | 274 | 56.0/65.7 | 2057 | 121.3 | 42.0/43.4 | 580 |

TABLE 2

SUMMARY OF RESULTS FROM EPDM - PROPELLANT BOND SPECIMENS

| Sample* | Type Specimen | Area Under+ S & S Curve | Stress+ | Strain+ Max/bk | Modulus+ | Comments** |
|---|---|---|---|---|---|---|
| OU | Lap Shear | 1.05 | 9.1 | 4.7/4.7 | 245 | Two specimens fell apart before testing |
| OC | Lap Shear | 4.26 | 32.4 | 10.5/10.5 | 335 | Soft at interface pulled away from EPDM |
| 78U | Lap Shear | 9.27 | 35.8 | 31.3/32.4 | 352 | Thick layer of Propellant (soft) left on EPDM |
| 78C | Lap Shear | 9.34 | 39.0 | 20.3/31.0 | 244 | Very thin layer propellant on EPDM |
| 79U | Lap Shear | 13.64 | 36.7 | 48.7/48.7 | 259 | Slight propellant film on EPDM |
| 79C | Lap Shear | 10.23 | 34.8 | 36.8/37.8 | 295 | Slight propellant film on EPDM |
| OU | Tensile | None | | | | Samples fell apart before testing propellant, very tacky at interface |
| OC | Tensile | 1.47 | 44.0 | 8.3/9.7 | 454 | Bond failure, propellant not tacky |
| 78U | Tensile | 9.53 | 82.0 | 22.7/24.4 | 594 | Broke in propellant |
| 78C | Tensile | 11.31 | 72.6 | 28.9/31.0 | 469 | Broke in propellant |
| 79C | Tensile | 9.42 | 77.0 | 25.3/27.7 | 460 | Broke in propellant |
| 79C | Tensile | 12.92 | 94.5 | 21.9/21.9 | 642 | Bond failure |

+77° F. physical property data
*O - vulcanized
U - samples uncoated
C - samples coated with TS3320-19
79 - samples are peroxide cured and pre-plasticized
78 - peroxide cured
**With respect to comments in Table 2 the following additional remarks are pertinent to certain comments set forth therein. Failure in the propellant matrix indicates that the propellant bond to liner strength exceeds that of the propellant itself; therefore, this is the desirable mode of failure to verify presence of a strong propellant composition to liner material.

The modes of failures for samples 78U, 78C, 79U, and 79C for lap shear specimens and tensile specimens indicate that specimens made in accordance with the method of this invention are very suitable for evaluating propellant to liner/insulation bond strengths.

I claim:

1. A method of preparing tensile strength and lap shear strength specimens for determining bond strength between a liner/insulation material and a cured hydroxyterminated polybutadiene propellant composition comprising:

(i) preparing a liner/insulation material of a predetermined dimension and thickness and having flat surfaces facing in opposite directions;

(ii) placing said liner/insulation material in a mold having a dogbone configuration and in a predetermined position in said mold;

(iii) casting a curable hydroxyterminated polybutadiene propellant composition onto a portion of said oppositely facing surfaces of said liner/insulation material;

(iv) curing said curable hydroxyterminated polybutadiene propellant composition to form a secure bond between said liner/insulation material oppositely facing surfaces and said cured propellant composition; and to provide a dogbone shaped specimen in which the hydroxyterminated polybutadiene is securely bonded to oppositely facing surfaces of said liner/insulation material; and (v) placing said tensile strength and lap shear strength specimens in a machine and determining bond strength between said liner/insulation material oppositely facing surfaces and said cured hydroxyterminated polybutadiene propellant composition.

2. The method of claim 1 wherein a first portion of said curable hydroxyterminated polybutadiene propellant composition is cast on a first portion of said surfaces of said liner/insulation material and a second portion of said curable hydroxyterminated polybutadiene propellant composition in cast on a second portion of said surfaces of said liner/insulation material.

3. The method of claim 1 wherein said curable hydroxyterminated polybutadiene propellant composition is cast in said mold and onto portions of said oppositely facing surfaces at opposite ends of said liner/insulation material with an intermediate portion of said oppositely facing surfaces having a discontinuance of propellant.

4. The method of claim 1 wherein a first portion of said curable hydroxyterminated polybutadiene propellant composition is cast on a first portion of said surfaces of said liner/insulation material and a second portion of said curable hydroxyterminated polybutadiene propellant composition is cast on a second portion of said surfaces of said liner/insulation material thereby providing a structure for testing the tensile strength of said curable hydroxyterminated polybutadiene propellant composition bonded to said liner/insulation material.

5. The method of claim 1 wherein said curable hydroxyterminated polybutadiene propellant composition is cast onto portions of said oppositely facing surfaces at opposite ends of said liner/insulation material with an intermediate portion of said oppositely facing surfaces having no propellant thereon thereby providing a structure for testing the lap shear strength of said curable hydroxyterminated polybutadiene propellant composition bonded to a liner/insulation material.

6. The method of claim 1 wherein prior to said casting of said curable hydroxyterminated polybutadiene propellant composition onto a portion of said surfaces of said liner/insulation material, said surfaces of said tensile and lap shear strength specimens are cleaned with methylene chloride, roughened with steel wool, passed under a magnet to remove residual steel wool, and rinsed with methylene chloride and dried to remove methylene chloride, and coated with a primer that is compatible with said tensile and lap shear strength specimens and said curable hydroxyterminated polybutadiene propellant composition and baked for about 30 minutes at 250° F.

* * * * *